United States Patent [19]

Mori et al.

[11] Patent Number: 4,582,620

[45] Date of Patent: Apr. 15, 1986

[54] SILICONE GREASE COMPOSITIONS

[75] Inventors: Shigeru Mori; Takayuki Takahashi, both of Gunma, Japan

[73] Assignee: Shin-Etsu Chemical Co., Ltd., Tokyo, Japan

[21] Appl. No.: 668,997

[22] Filed: Nov. 5, 1984

[30] Foreign Application Priority Data

Nov. 14, 1983 [JP] Japan ..... 58-213475

[51] Int. Cl.[4] ..... C10M 107/50; C10M 107/02

[52] U.S. Cl. ..... 252/43; 252/49.6

[58] Field of Search ..... 252/49.6, 43

[56] References Cited

U.S. PATENT DOCUMENTS

| | | | |
|---|---|---|---|
| 2,614,989 | 10/1952 | Hunter et al. | 252/49.6 |
| 2,680,095 | 1/1954 | Hotten et al. | 252/49.6 |
| 4,043,924 | 8/1977 | Traver | 252/28 |
| 4,065,395 | 12/1977 | Bailey | 252/25 |
| 4,213,869 | 7/1980 | Kosinsky | 252/49.6 |
| 4,406,800 | 9/1983 | Christian | 252/49.6 |

FOREIGN PATENT DOCUMENTS 53776 12/1975 Japan .

*Primary Examiner*—Jacqueline V. Howard

*Attorney, Agent, or Firm*—Wenderoth, Lind & Ponack

[57] ABSTRACT

The silicone grease composition of the invention comprises an organopolysiloxane which is preferably a linear-chain diorganopolysiloxane, a thermoplastic resin having a softening point of 50° C. or higher which is preferably a terpene resin or a petroleum resin and a thickener in limited proportions. Different from conventional silicone grease compositions composed of an organopolysiloxane and a thickener, the inventive silicone grease composition is suitable to impart dragging movability to the bodies in sliding contact and the performance thereof is very stable over a wide range of temperature from −40° to +80° C.

4 Claims, No Drawings

SILICONE GREASE COMPOSITIONS

BACKGROUND OF THE INVENTION

The present invention relates to a silicone grease composition or, more particularly, to a grease composition comprising an organopolysiloxane as the base ingredient and capable of imparting dragging movability to the surfaces of bodies contacting with each other in a relative movement.

When surfaces of bodies contact each other with relative movement, such as in the shaft and bearing of a rotary-type variable resistor in an audio set, eject damper and pick-up damper in a cassette deck and the like it is often the practice to impart dragging movability thereto. The grease compositions currently used for such purpose include those comprising an organopolysiloxane as the base ingredient and those comprising a polybutene as the ingredient. In particular, Japanese Patent Publication No. 53-776 discloses a silicone grease composition comprising a dimethylpolysiloxane of a linear-chain molecular structure and an organopolysiloxane composed of monofunctional siloxane units $R^1{}_3SiO_{0.5}$, difunctional siloxane units $R^2{}_2SiO$ and tetrafunctional siloxane units $SiO_2$, in which $R^1$ and $R^2$ are each a monovalent hydrocarbon group, as the organopolysiloxane component with admixture of a thickener and Japanese Patent Kokai No. 56-897 discloses a grease composition comprising an organopolysiloxane and a polybutene as the base oil component with admixture of sodium n-octadecyl terephthalamate and finely divided silicon dioxide filler. These grease compositions in the prior art are, however, not quite satisfactory in respect of the performance at low temperatures and have a disadvantage of poor stability that the movement time is gradually shortened when they are worked repeatedly.

SUMMARY OF THE INVENTION

It is therefore an object of the present invention to provide a novel and improved silicone grease composition free from the above mentioned problems and disadvantages of the prior art grease compositions in respect of the low temperature performance and long-term stability.

Thus, the silicone grease composition of the present invention comprises:

(a) 100 parts by weight of a mixture composed of (a-1) from 10 to 90% by weight of an organopolysiloxane and (a-2) from 90 to 10% by weight of a thermoplastic resin having a softening point of 50° C. or higher; and (b) from 1 to 30 parts by weight of a thickener.

The above described silicone grease composition is characteristic in the admixture of a specific thermoplastic resin having a softening point of 50° C. or higher with a composition composed of an organopolysiloxane as the base oil and a thickener which may be a known material. The viscosity behavior of the grease composition is very stable over a wide temperature range exhibiting satisfactory dragging movability even at high temperatures and is usable in repeated service.

DETAILED DESCRIPTION OF THE PREFERRED EMBODIMENTS

The organopolysiloxane, i.e. component (a-1), as the base oil in the inventive silicone grease composition is represented by the general formula $$R^1{}_3Si—O—SiR^2{}_2—O)_nSiR^1{}_3, \quad (I)$$

in which $R^1$ is a hydroxy group or a monovalent hydrocarbon group, $R^2$ is a monovalent hydrocarbon group and n is a positive integer. The monovalent hydrocarbon groups suitable as the groups $R^1$ and $R^2$ is exemplified by alkyl groups such as methyl, ethyl, propyl and butyl groups, alkenyl groups such as vinyl and allyl groups, aryl groups such as phenyl and tolyl groups and halogenated alkyl groups such as chloromethyl and trifluoropropyl groups. Although the groups denoted by $R^1$ and $R^2$ in with molecule may be the same or different types of the above named monovalent groups, it is preferable that at least 50% by moles thereof should be methyl groups. The organopolysiloxane usually has a linear-chain molecular structure as is shown by the general formula (I) given above but side chains have no particularly adverse effect provided that the number thereof is limited. The organopolysiloxane should have a viscosity in the range from 10 to 500,000 centistokes at 25° C.

The organopolysiloxane component (a-1) of the inventive silicone grease composition may be a mixture composed of the above described diorganopolysiloxane represented by the general formula (I) and a second organopolysiloxane represented by the general formula $$(R^1{}_3SiO_{0.5})_w(R^1{}_2SiO)_x(R^1SiO_{1.5})_y(SiO_2)_z, \quad (II)$$

in which $R^1$ has the same meaning as defined above and the suffixes w, x, y and z are each the mole fraction of the respective siloxane units given by the equations:

$$w/(w+x+y+z)=0.35 \text{ to } 0.55;$$

$$x/(w+x+y+z)=0 \text{ to } 0.40;$$

$$y/(w+x+y+z)=0 \text{ to } 0.10; \text{ and}$$

$$z/(w+x+y+z)=0.65 \text{ to } 0.45.$$

The mixture should have a viscosity in the range from 100 to 500,000 centistokes at 25° C.

The component (a-2) to be combined with the organopolysiloxane as the component (a-1) is a thermoplastic resin having a softening point of 50° C. or higher as determined by the ring-and-ball method. Thermoplastic resins having a softening point lower than 50° C. are poorly dispersible in the organopolysiloxane. Preferable thermoplastic resins include terpene resins and petroleum resins available on the market with various tradenames. Exemplary of the commercial products of these resins are: polyterpene resins such as Piccolites S-70 and S-10 (products by Picco Co.); C5 type or C9 type petroleum resins such as Quintons A-100, B-100 and D-100 (products by Nippon Zeon Co.), polyolefin resins such as Piccopale 100 (product by Hercules Co.) and coumarone-indene resins such as Coumarone-indene RC ½ as well as rosin-based resins, of which the polyterpene resins and C5 type petroleum resins having good miscibility with the organopolysiloxane are preferred.

The thickener as the component (b) used in the inventive silicone grease composition serves to impart to the mixture of the organopolysiloxane as the component (a-1) and the thermoplastic resin as the component (a-2), a consistency as a grease and to maintain the consistency with stability. The thickener may be any one of those conventionally used in grease compositions including various kinds of metal soaps, fine powders of fluorocarbon resins, phthalocyanines, indanthrene, allyl urea, finely divided silica powders, carbon blacks, clays, bentonites and the like.

The silicone grease composition of the present invention can be prepared by uniformly blending the above described components (a-1), (a-2) and (b) in a suitable proportion. The amount of the thickener as the component (b) should be in the range from 1 to 30 parts by weight per 100 parts by weight of the mixture of the organopolysiloxane as the component (a-1) and the thermoplastic resin as the component (a-2) while the mixture of the components (a-1) and (a-2) should be composed of from 10 to 90% by weight of the former and 90 to 10% by weight of the latter. When the amount of the organopolysiloxane is smaller than the above proportion, the resultant composition is too thick without greasy consistency while a grease composition prepared using the organopolysiloxane in an excessively large proportion can no longer exhibit stable rheological behavior for dragging movability over a wide temperature range.

It is of course optional that the inventive silicone grease composition is formulated with various kinds of conventional additives known and used in the preparation of grease compositions such as antioxidants, rust-proofing agents, coloring agents and the like according to need.

In the following, Examples and Comparative Examples are given to illustrate the inventive silicone grease compositions in more detail, in which the expression of "parts" in each occurrence refers to "parts by weight" and the values of viscosity were obtained by the measurement at 25° C.

EXAMPLE 1 AND COMPARATIVE EXAMPLE 1

A grease composition having a consistency of 200 was prepared by blending in a blending machine 60 parts of methyl phenyl polysiloxane having a viscosity of 3000 centistokes, 40 parts of a petroleum resin having a softening point of 100° C. (Quint A-10, supra) and 10 parts of finely divided silica filler after a hydrophobic surface treatment with an organopolysiloxane followed by kneading in a three-roller mill.

The grease composition was applied to the surface of an aluminum-made shaft having a diameter of 4 mm and a length of 8 mm and the shaft was inserted into a die-cast bearing of zinc and rotated at a velocity of 10 rpm to determine the value of torque in g-m at varied temperatures from −40° to +80° C. The results of the torque determination are shown in Table 1 below, from which it is understood that the performance of the grease composition is very stable over the temperature range.

For comparison, a similar grease composition was prepared from a polybutene, mineral oil and silica filler and subjected to the same test of torque determination to give the results also shown in Table 1. As is clear from this table, the temperature dependency of the torque of the comparative grease composition was very large and the torque could no longer be determined when the temperature was decreased to −20° C.

EXAMPLE 2

A grease composition having a consistency of 210 was prepared by blending 65 parts of a dimethylpolysiloxane having a viscosity of 5000 centistokes, 35 parts of a terpene resin having a softening point of 70° C. and 10 parts of a finely divided silica filler followed by kneading in a three-roller mill. This grease composition was subjected to the test for the determination of the torque in the same manner as in Example 1 to give the results shown in Table 1. As is clear from the results, the value of torque with this grease composition was stable over a wide range of temperature.

TABLE 1

| | Torque, g-cm | | | | | | | |
|---|---|---|---|---|---|---|---|---|
| Temperature, °C. | Example 1 | Example 2 | Example 3 | Example 4 | Example 5 | Example 6 | Comparative Example 1 | Comparative Example 2 |
| +80 | 21 | 14 | — | — | — | 21 | 5 | 14 |
| +60 | 22 | 16 | 28 | 13 | 22 | 22 | 12 | 16 |
| +25 | 24 | 18 | 32 | 15 | 23 | 22 | 28 | 19 |
| 0 | 24 | 18 | 32 | 15 | 23 | 22 | 63 | 25 |
| −10 | 24 | 18 | — | 18 | 24 | — | 93 | — |
| −20 | — | — | — | — | — | 22 | Solidified | 40 |
| −30 | 25 | 20 | 36 | 22 | 27 | — | — | — |
| −40 | 28 | — | — | — | — | 25 | 68 | — |

EXAMPLE 3

A grease composition having a consistency of 170 was prepared by blending 50 parts of a methylphenyl polysiloxane having a viscosity of 500 centistokes and a flowing point of −65° C., 50 parts of a petroleum resin having a softening point of 100° C. (Quinton C-100, supra) and 6 parts of a finely divided silica filler having the surface treated with an organopolysiloxane followed by kneading in a three-roller mill. The results of testing for the determination of the torque undertaken in the same manner as in Example 1 were as shown in Table 1.

EXAMPLE 4

A grease composition having a consistency of 160 was prepared by blending 70 parts of a methyl trifluoropropyl polysiloxane having a viscosity of 1000 centistokes, 30 parts of a petroleum resin having a softening point of 85° C. (Quinton U-185, a product by Nippon Zeon Co.) and 15 parts of the same finely divided silica filler as used in Example 1 followed by kneading in a three-roller mill. The results of testing for the determination of the torque undertaken in the same manner as in Example 1 were as shown in Table 1.

EXAMPLE 5

A silicone grease composition having a consistency of 220 was prepared by blending 60 parts of a methyl phenyl polysiloxane having a viscosity of 1000 centistokes, 40 parts of a petroleum resin (Clayton A-100, supra), 15 parts of lithium stearate and an amine-based antioxidant (Orthorium #300, a product by Du Pont Co.) followed by kneading in a three-roller mill. The results of testing for the determination of the torque undertaken in the same manner as in Example 1 were as shown in Table 2.

EXAMPLE 6 AND COMPARATIVE EXAMPLE 2

A grease composition having a consistency of 220 was prepared by blending 60 parts of a mixture having a viscosity of 30,000 centistokes and composed of 65% by weight of a methyl phenyl polysiloxane having a viscosity of 3000 centistokes and 35% by weight of a methylpolysiloxane composed of the monofunctional $(CH_3)_3SiO_{0.5}$ units and tetrafunctional $SiO_2$ units in a molar ratio of 0.7:1, 40 parts of the same petroleum resin as used in Example 1 and 10 parts of a finely divided silica filler having the surface treated with an organopolysiloxane followed by kneading in a three-roller mill. The results of testing of this grease composition for the determination of the torque undertaken in the same manner as in Example 1 were as shown in Table 1.

For comparison, another grease composition was prepared from 85 parts of the same mixture of organopolysiloxanes as used above and 15 parts of the same surface-treated finely divided silica filler with omission of the petroleum resin. The results of testing with this comparative grease composition for the determination of the torque were as shown in Table 1.

What is claimed is:

1. A silicone grease composition which comprises:
(a) 100 parts by weight of a mixture composed of (a-1) from 10 to 90% by weight of an organopolysiloxane and (a-2) from 90 to 10% by weight of a thermoplastic resin having a softening point of 50° C. or higher; and
(b) from 1 to 30 parts by weight of a thickener.

2. The silicone grease composition as claimed in claim 1 wherein the organopolysiloxane is a linear-chain diorganopolysiloxane represented by the general formula $$R^1{}_3Si—O—SiR^2{}_2—O)_nSiR^1{}_3,$$

in which $R^1$ is a hydroxy group or a monovalent hydrocarbon group, $R^2$ is a monovalent hydrocarbon group and n is a positive integer, and having a viscosity in the range from 10 to 500,000 centistokes at 25° C.

3. The silicone grease composition as claimed in claim 1 wherein the organopolysiloxane is a mixture of a linear-chain diorganopolysiloxane represented by the general formula $$R^1{}_3Si—O—SiR^2{}_2—O)_nSiR^1{}_3,$$

in which $R^1$ is a hydroxy group or a monovalent hydrocarbon group, $R^2$ is a monovalent hydrocarbon group and n is a positive integer, and an organopolysiloxane represented by the general formula $$(R^1{}_3SiO_{0.5})_w(R^1{}_2SiO)_x(R^1SiO_{1.5})_y(SiO_2)_z,$$

in which $R^1$ has the same meaning as defined above and the suffixes w, x, y and z are each the mole fraction of the respective siloxane units given by the equations of:

$$w/(w+x+y+z)=0.35 \text{ to } 0.55;$$

$$x/(w+x+y+z)=0 \text{ to } 0.40;$$

$$y/(w+x+y+z)=0 \text{ to } 0.10; \text{ and}$$

$$z/(w+x+y+z)=0.65 \text{ to } 0.45,$$

and having a viscosity in the range from 100 to 500,000 centistokes at 25° C.

4. The silicone grease composition as claimed in claim 1 wherein the thermoplastic resin is a terpene resin or a petroleum resin.

* * * * *